US007669373B2

(12) United States Patent
Muir

(10) Patent No.: US 7,669,373 B2
(45) **Date of Patent: *Mar. 2, 2010**

(54) BUILDING MEANS

(75) Inventor: Robert Anthony Muir, Wellington (NZ)

(73) Assignee: Ridvan Garden Developments Ltd. (NZ)

( * ) Notice: Subject to any disclaimer, the term of this patent is extended or adjusted under 35 U.S.C. 154(b) by 986 days.

This patent is subject to a terminal disclaimer.

(21) Appl. No.: 11/243,024

(22) Filed: Oct. 4, 2005

(65) Prior Publication Data

US 2006/0075716 A1 Apr. 13, 2006

(51) Int. Cl.
*E04B 1/38* (2006.01)

(52) U.S. Cl. ..... 52/506.06; 52/512; 52/510; 52/509

(58) Field of Classification Search ..... 52/506.06, 52/512, 510, 509, 98, 703, 551, 545, 48
See application file for complete search history.

(56) References Cited

U.S. PATENT DOCUMENTS 1,052,670 A * 2/1913 Francis ..... 52/509
1,888,611 A * 11/1932 Wolfson ..... 52/512
2,304,333 A * 12/1942 Bossi ..... 52/509
3,181,662 A * 5/1965 Maertzig, Jr. ..... 52/509
3,998,019 A * 12/1976 Reinwall, Jr. ..... 52/478
4,156,993 A * 6/1979 Sorrells, Jr. ..... 52/60
4,299,069 A * 11/1981 Neumann ..... 52/309.4
4,607,471 A * 8/1986 Olsen ..... 52/509
4,616,462 A * 10/1986 Abendroth ..... 52/509
4,727,700 A * 3/1988 Eberle ..... 52/417
5,255,484 A * 10/1993 Karlsohn ..... 52/506.05
5,265,396 A * 11/1993 Amimoto ..... 52/745.12
6,568,657 B2 * 5/2003 Muir ..... 256/65.06
2006/0218874 A1 * 10/2006 Muir ..... 52/766

* cited by examiner

*Primary Examiner*—Basil Katcheves
(74) *Attorney, Agent, or Firm*—Galbreath Law Offices, P.C.; John A. Galbreath

(57) ABSTRACT

Building means, having a main plate 1, a lower ledge 2 extending outwards of a first face of the plate, a first bolt portion 4 extending outwards of the first face of the plate and a second bolt portion 5 extending outwards of a second face of the plate opposite the first face; the building means being formed such that when it is in use a structural member can be fastened to the first bolt portion 4 while the plate 2 is arranged at least partially behind exterior cladding 8 of a building so that the ledge 2 extends to beyond the cladding 8, and wherein rainwater contacting the first face of the plate can run down the first face and be guided by the ledge 2 to a drain away position in front of the cladding.

6 Claims, 3 Drawing Sheets

BUILDING MEANS

CROSS-REFERENCES TO RELATED APPLICATIONS

This application claims priority under the Paris Convention and 35 U.S.C. 119 (a)-(d) or (f), or 365 (b) to New Zealand Application No. 535822, filed on 8 Oct. 2004.

FIELD OF THE INVENTION

This invention relates to building means. A preferred form of the invention relates to means for use in attaching structural members at or adjacent the exterior cladding of a house or other building.

BACKGROUND

It is often necessary to fix structural members such as deck joists or pergola beams to the exterior part of a building. This presents a problem in that the point of contact between the structural member and the building may present an area where rainwater is able to enter the building and, over time, cause rot or other damage to internal wall framing, etc. It is accordingly an object of one form of the present invention to go at least some way towards addressing this problem, or to provide the public with a useful choice.

The term "comprising", "comprises", or derivatives thereof, if and when used herein, should be interpreted non-exclusively—ie to convey "consisting of or including".

SUMMARY OF THE INVENTION

According to one aspect of the invention there is provided building means, having a main plate portion (eg a plate), a ledge (eg a turned portion of the plate) extending outwards of a first face of the plate portion, a first bolt portion extending outwards of the first face of the plate portion and a second bolt portion extending outwards of a second face of the plate portion opposite the first face; the building means being formed such that when it is in use a structural member (eg a joist) can be fastened to the first bolt portion while at the same time the plate portion is arranged at least partially behind exterior cladding of a building (eg a house) so that the ledge extends to beyond the cladding, wherein rainwater contacting the first face of the plate portion can run down the first face and be guided by the ledge to a drain away position in front of the cladding.

Preferably the building means has supportive packing on the first face of the plate portion and the first bolt portion extends outwardly from the supportive packing.

Preferably the building means is at least substantially formed from a corrosion resistant metallic substance—eg stainless steel.

Preferably the ledge has a notch line or notch lines adapted to enable a fold to be readily made in the ledge.

According to another aspect of the invention there is provided a method of securing a structural member (eg a joist) adjacent a building (eg a house), involving the steps of:

i) taking a building means as described above, ii) arranging the plate portion between wall framing and external cladding of the building so that the ledge and the first bolt portion extend to positions in front of the cladding with the second bolt portion secured to the wall framing, and iii) securing a structural member (eg a joist) to the first bolt portion, the method being such that in the event rainwater contacts the plate portion it is able to drain to the ledge, and then from the ledge in front of the cladding.

DESCRIPTION OF THE DRAWINGS

Some preferred embodiments of the invention will now be described by way of example with reference to the accompanying drawings, of which.

DETAILED DESCRIPTION

Figure 1:
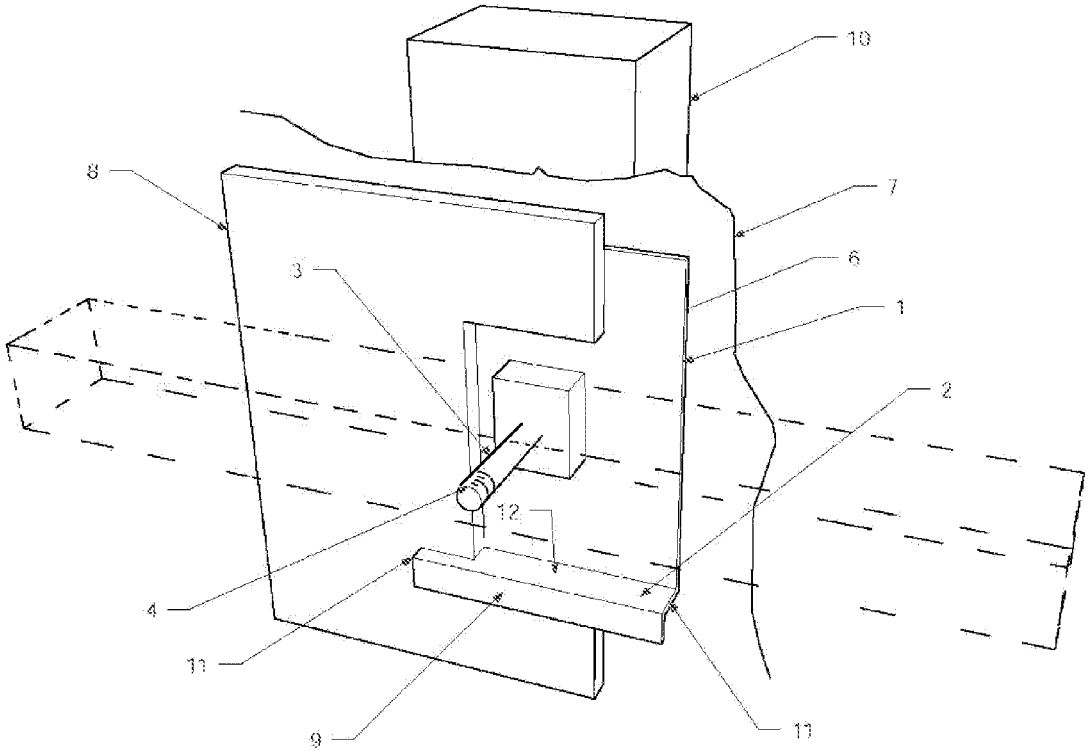
FIG. 1 is a side elevation view of a connector.
Figure 2:
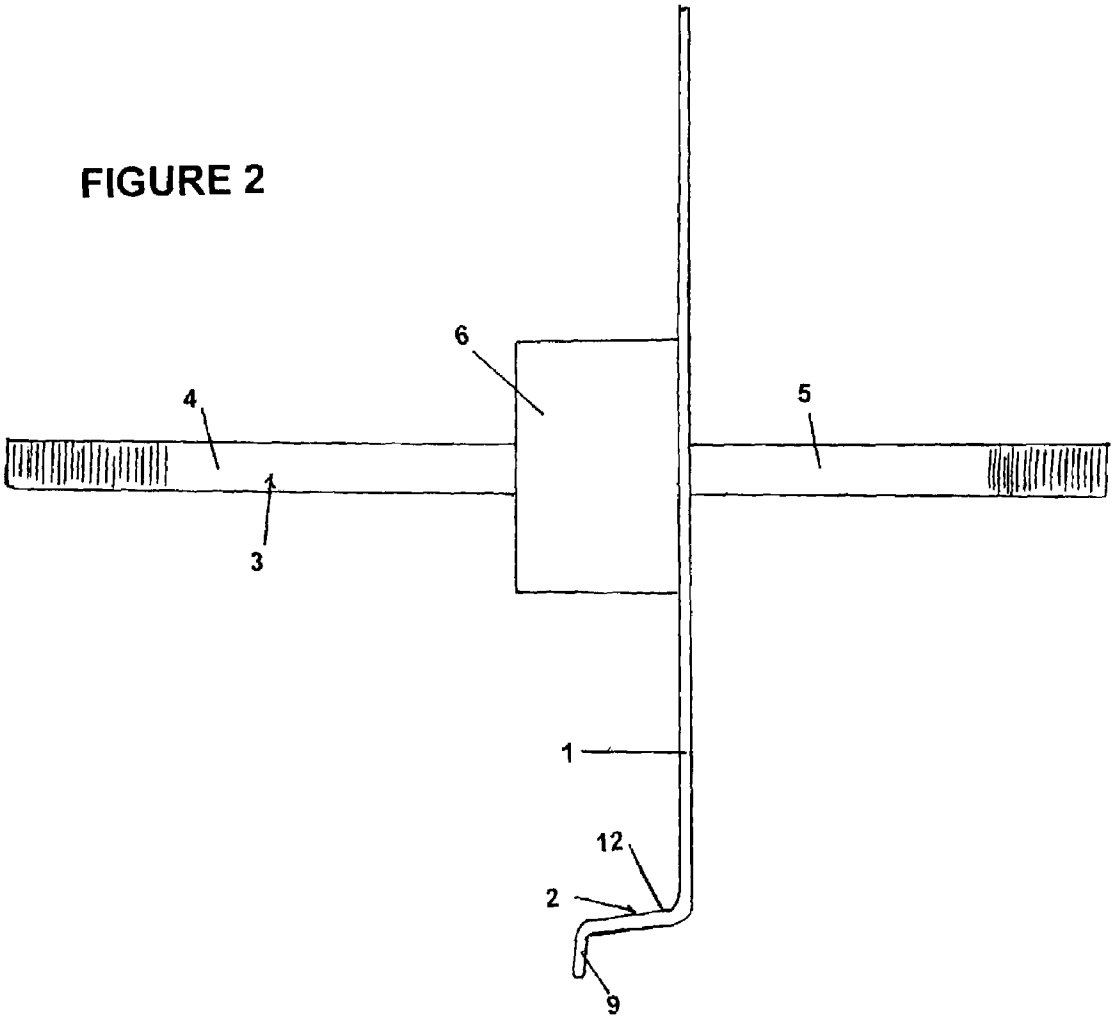
FIG. 2 is a front perspective view of the connector when in use.

As shown in FIGS. 1 and 2, the connector comprises a main plate 1 and a lower ledge 2. The ledge 2 is essentially a folded part of the plate 1. The fold is such that the ledge 2 turns out from the plate at slightly more than 90 degrees and then downwards to run parallel to the plate 1. A threaded bolt 3 which has a first portion 4 and a second portion 5 passes at right angles through the plate 1 and through a supportive packing block 6 on a first face of the plate.

Referring to FIG. 2, when the connector is in use it is arranged against building paper 7 laid over the exterior wall framing 10 of a house or other building. More specifically, the plate 1 is between the building paper/framing on one hand and the building's exterior wall cladding 8 on the other. Preferably the connector is arranged at a position where two sheets of exterior cladding butt up against one another, although for the sake of clarity FIG. 2 only shows one such sheet 8. FIG. 2 shows that a recess has been cut in the cladding 8 to accommodate the connector. The ledge 2 extends from the plate 1 to a position in front of the cladding. As also shown in FIG. 2, the down turned part 9 of the ledge is slightly in front of the cladding.

The connector is secured to the internal wall framing 10 behind the building paper 7 by way of the second portion 5 of the bolt 3. The first portion 4 of the bolt and the block 6 extend outwards of the plate 1 to positions in front of the cladding 8. A joist or other structural member (not shown) can be butted against the block 6 and secured to the first portion 4 of the bolt—ie after drilling a hole in the joist and passing the bolt therethrough. The joist may or may not be part of a deck area. Preferably silicon sealant is placed between the cladding and the connector to assist in creating a weatherproof arrangement. Weatherproofing may also be assisted by applying adhesive building tape over the main edges of the plate 1 where these meet the building paper 7.

When the invention is in use rainwater which is able to get in behind the joist contacts the plate 1 and runs down to the ledge 2. The ledge guides the rainwater away from the plate to a position in front of the cladding 8. From there the rain water is able to drip from the down turned part 9 of the ledge rather than enter wall cavities and cause timber rot or other damage. To assist in directing water away from the connector the edges 11 of the outward extending part 12 of the ledge may formed with a very slight up turn to assist in directing the rainwater to the down turned part 9. Referring to FIG. 1, the outward extending part 12 is at an angle of just over 90 degrees with respect to the plate 1. This results in gravity assisting rainwater to drain away from the plate rather than undesirably collecting on the outward extending part 12 of the ledge.

Preferably the connector is formed from stainless steel or some other corrosion resistant metallic substance. The block 6 may be substantially hollow, although that is not essential.

Figure 3:
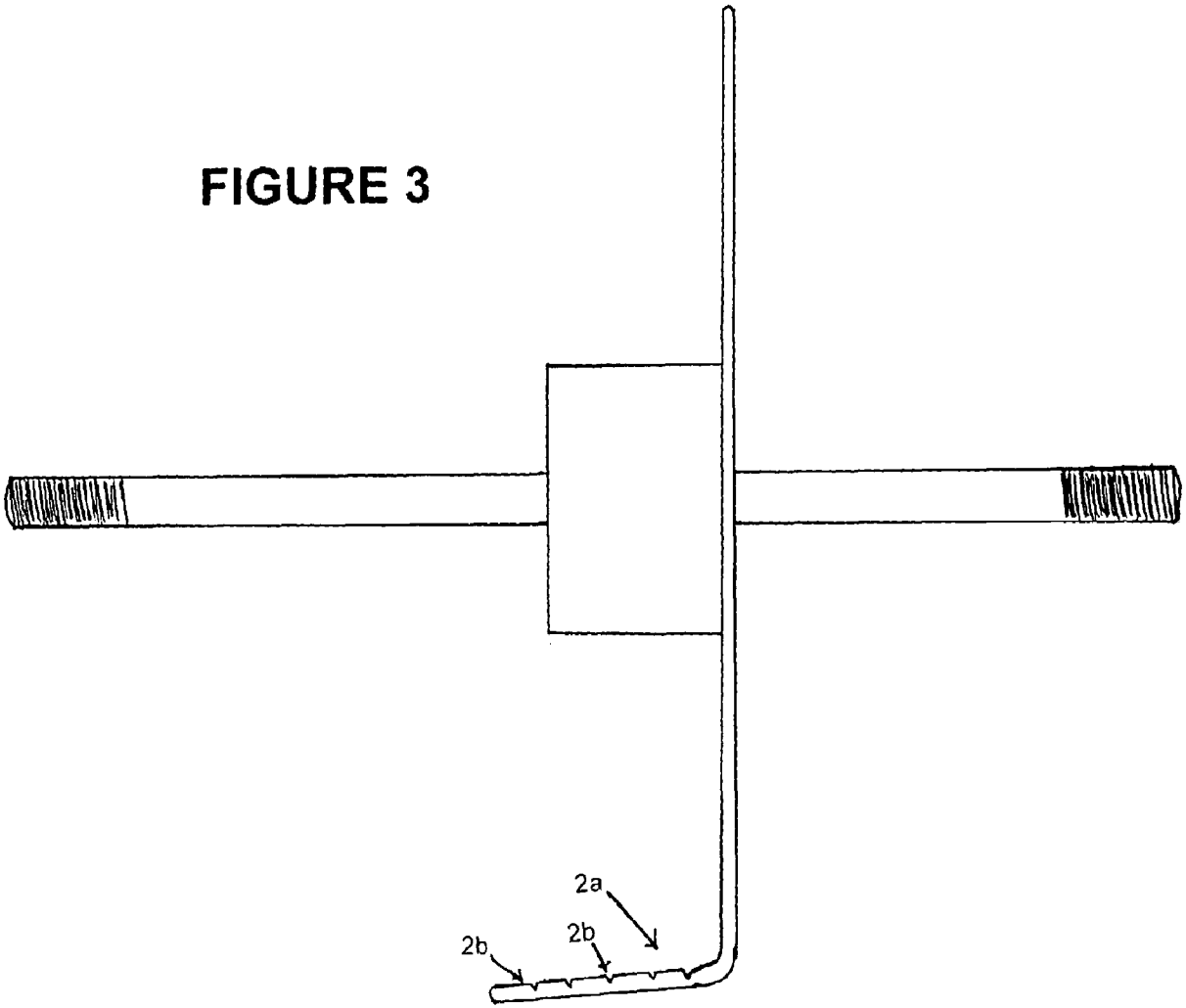
FIG. 3 is side elevation view of a connector in an alternative form to that shown for the connector of FIG. 1.

FIG. 3 shows a connector similar to that of FIGS. 1 and 2, except that its ledge 2*a* is only partially formed. The ledge 2*a* has a series of spaced notch lines 2*b* (or other lines of weakness generally) extending across the width of the connector to define optional fold lines for creating a down turned part as per the down turned part 9 mentioned above. The use of notch lines means that it is relatively easy to make a neat fold in the ledge to give a connector shape as per FIG. 2. The fold can be made at an appropriate one of the notch lines depending on the thickness of the cladding that one is working with.

While some preferred forms of the invention have been described by way of example it should be appreciated that modifications and improvements can occur without departing from the scope of the appended claims.

The invention claimed is:

1. Building means, having a main plate portion, a first bolt portion extending outwards of a first face of the main plate portion, a second bolt portion extending outwards of a second face of the main plate portion, and a ledge extending outwards of the first face;

the building means fixed to a building such that the main plate portion is upright between exterior cladding of the building and internal framing of the building, the ledge extending from the main plate portion to a position in front of the exterior cladding, a structural building member secured to the first bolt portion in front of the cladding and the second bolt portion secured to the internal framing;

the building means being formed and arranged such that when rainwater contacts the first face of the main plate portion it runs down that first face and is guided by the ledge to drain away from the building means in front of the exterior cladding.

2. Building means according to claim 1, having supportive packing on the first face of the plate portion wherein the first bolt portion extends outwardly from the supportive packing.

3. Building means according to claim 1, which is at least substantially formed from a corrosion resistant metallic substance, and having supportive packing on the first face of the plate portion wherein the first bolt portion extends outwardly from the supportive packing.

4. Building means according to claim 1, having supportive packing on the first face of the plate portion wherein the first bolt portion extends outwardly from the supportive packing, and wherein the ledge has a line or lines of weakness adapted to enable a fold to be readily made in the ledge.

5. A method of securing a structural member adjacent a building, involving the steps of:

i) obtaining a building means having a main plate portion, a ledge extending outwards of a first face of the plate portion, a first bolt portion extending outwards of the first face of the plate portion and a second bolt portion extending outwards of a second face of the plate portion opposite the first face; the building means being formed such that when it is in use a structural member can be fastened to the first bolt portion while the plate portion is arranged at least partially behind exterior cladding of a building so that the ledge extends to beyond the cladding, and wherein rainwater contacting the first face of the plate portion can run down the first face and be guided by the ledge to a drain away position in front of the cladding, ii) arranging the plate portion between wall framing and external cladding of the building so that the ledge and the first bolt portion extend to positions in front of the cladding with the second bolt portion secured to the wall framing, and iii) securing a structural member in front of the cladding to the first bolt portion, the method being such that in the event rainwater contacts the plate portion it is able to drain to the ledge, and then from the ledge in front of the cladding.

6. A building or a part thereof at least partially formed in accordance with the method of claim 5.

* * * * *